US010266335B2

(12) United States Patent
Krasiev et al.

(10) Patent No.: US 10,266,335 B2
(45) Date of Patent: Apr. 23, 2019

(54) CONTAINER WITH CUSTOMISABLE OPENING-AND-CLOSING MECHANISM OF INNER PACKAGE

(71) Applicant: PHILIP MORRIS PRODUCTS S.A., Neuchatel (CH)

(72) Inventors: Sergey Krasiev, Le Mont-sur-Lausanne (CH); Adrian Eggen, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/529,707

(22) PCT Filed: Dec. 21, 2015

(86) PCT No.: PCT/EP2015/080786

§ 371 (c)(1),
(2) Date: May 25, 2017

(87) PCT Pub. No.: WO2016/102461

PCT Pub. Date: Jun. 30, 2016

(65) Prior Publication Data

US 2017/0327303 A1 Nov. 16, 2017

(30) Foreign Application Priority Data

Dec. 23, 2014 (EP) ..... 14200005

(51) Int. Cl.
*B65D 85/10* (2006.01)
*B65D 5/02* (2006.01)
(Continued)

(52) U.S. Cl.
CPC ..... *B65D 85/1045* (2013.01); *B65D 5/02* (2013.01); *B65D 5/0281* (2013.01); *B65D 5/48* (2013.01);
(Continued)

(58) Field of Classification Search
CPC ... B65D 5/02; B65D 5/48; B65D 5/66; B65D 5/6602; B65D 65/42; B65D 75/04;
(Continued)

(56) References Cited

U.S. PATENT DOCUMENTS 3,039,671 A * 6/1962 Efthem ..... B65D 85/1045 206/256
4,081,126 A * 3/1978 Barnard ..... B65D 85/1045 206/256
(Continued)

FOREIGN PATENT DOCUMENTS

CN 203450510 2/2014
CN 203473580 3/2014
(Continued)

OTHER PUBLICATIONS

International Search Report and Written Opinion for PCT/EP2015/080786 dated Mar. 4, 2016 (9 pages).
(Continued)

*Primary Examiner* — Bryon P Gehman
(74) *Attorney, Agent, or Firm* — Mueting, Raasch & Gebhardt, P.A.

(57) ABSTRACT

A container for consumer goods comprises an outer housing having a box and a lid (103) hinged to the box along a hinge line and pivotable about the hinge line between an open position and a closed position. Further, the container comprises an inner package (104) of consumer goods within the outer housing comprising an access opening (105) for removing consumer goods when the lid is in the open position. The container further comprises a reclosable flap (106) occluding the access opening and at least one activatable adhesive element (107) provided on a surface of the reclosable flap, on a surface of the lid or on both. The adhesive element can be selectively activated, and the reclosable flap can be affixed to the lid by the activated
(Continued)

adhesive element, such that upon opening the lid the reclosable flap is lifted off the inner package to at least partly reveal the access opening.

14 Claims, 4 Drawing Sheets

(51) Int. Cl.

| | |
|---|---|
| ***B65D 5/48*** | (2006.01) |
| ***B65D 5/66*** | (2006.01) |
| ***B65D 65/42*** | (2006.01) |
| ***B65D 75/04*** | (2006.01) |
| ***B65D 75/58*** | (2006.01) |
| ***B65D 77/02*** | (2006.01) |

(52) U.S. Cl.
CPC ..... *B65D 5/6602* (2013.01); *B65D 65/42* (2013.01); *B65D 75/04* (2013.01); *B65D 75/5833* (2013.01); *B65D 77/02* (2013.01); *B65D 75/5838* (2013.01); *B65D 2575/586* (2013.01)

(58) Field of Classification Search
CPC .... B65D 75/58; B65D 75/5832; B65D 77/02; B65D 85/10; B65D 85/1045; B65D 2575/586; B65D 75/5833; B65D 5/0281; B65D 5/5838
USPC ..... 206/256–258, 261, 262, 268
See application file for complete search history.

(56) References Cited

U.S. PATENT DOCUMENTS

| | | | | |
|---|---|---|---|---|
| 6,726,006 | B1 * | 4/2004 | Funderburk | B65D 85/1045 206/256 |
| 8,091,703 | B2 * | 1/2012 | Marchetti | B65D 85/1045 206/268 |
| 9,089,165 | B2 * | 7/2015 | Bertuzzi | B65D 85/1045 |
| 9,499,331 | B2 * | 11/2016 | Seyfferth De Oliveira | B65D 85/1045 |
| 2015/0034509 | A1 * | 2/2015 | Seyfferth De Oliveira | B65D 85/1045 206/268 |
| 2015/0041346 | A1 * | 2/2015 | Seyfferth De Oliveira | B65D 85/1045 206/268 |
| 2015/0321831 | A1 * | 11/2015 | Ghini | B65D 85/1045 206/268 |

FOREIGN PATENT DOCUMENTS

| | | |
|---|---|---|
| CN | 104114464 | 10/2014 |
| GB | 585258 | 2/1947 |
| WO | WO 2008/142540 | 11/2008 |
| WO | WO 2013/131620 | 9/2013 |
| WO | WO 2014/097064 | 6/2014 |

OTHER PUBLICATIONS

Office Action issued in China for Application No. 201580068309.7 dated Aug. 1, 2018 (18 pages). English translation included.

* cited by examiner

CONTAINER WITH CUSTOMISABLE OPENING-AND-CLOSING MECHANISM OF INNER PACKAGE

This application is a U.S. National Stage Application of International Application No. PCT/EP2015/080786, filed Dec. 21, 2015, which was published in English on Jun. 30, 2016, as International Publication No. WO 2016/102461 A1. International Application No. PCT/EP2015080786 claims priority to European Application No. 14200005.8 filed Dec. 23, 2014.

The present invention relates to a container for consumer goods comprising an outer hinge lid box and an inner package of consumer goods within the outer hinge lid box. In particular, the container of the present invention finds application as a container for elongate consumer goods.

Smoking articles such as cigarettes and cigars are typically packaged in rigid hinge-lid containers. The bundle of smoking articles housed in the box is commonly wrapped in an inner liner, or package, of metallised paper, metal foil or other flexible sheet material. To access the bundle of smoking articles within the inner liner, a consumer should remove an upper portion of the inner liner upon first opening of the hinge-lid container. A sealed condition of the inner package is appreciated by consumers as proof that the goods inside the package are preserved in a fresh state at least until the first opening of the container.

Other containers are known, for example from WO-A-2008/142540, wherein the smoking articles are enclosed in an inner package with an extraction opening removably closed by a cover flap that is releasably affixed to the inner package using non-dry adhesive applied to the underside of the cover flap. This makes the inner package resealable. Such packages may be placed in a hinge-lid container. A portion of the cover flap can also be glued permanently and non-removably to an inner surface of the front wall of the lid so that opening and closing of the lid results in the simultaneous opening and closing of the cover flap and the extraction opening can be revealed and covered repeatedly.

Manufacture of such reclosable containers can be quite complex, because it requires that precise amounts of glue be applied to predetermined portions of the inner surface of the lid. Further, the packing apparatus for making the containers needs to comprise means adapted to handle the adhesive label because a main portion of the adhesive label is applied over the extraction opening in order to seal the inner package while an end portion of the adhesive label is affixed to the inner surface of the lid. This makes the packaging apparatus complicated from both structural and operational standpoints. Further, smoothness and reliability of the opening mechanism need to be guaranteed for ease of use of the container. To achieve this purpose, it is important that the main portion of the label is not accidentally bonded to the lid. Therefore, precision is required for an operation that, in order to ensure a satisfactory throughput, needs to be carried out at high speeds.

It would be desirable to provide a container for consumer goods that overcomes the drawbacks described above. Further, it would be desirable to provide a container for consumer goods whereby the consumer is allowed to check the proper sealing of the container prior to the first opening, and by which the consumer is able to create and, to an extent, customise operation of an opening and closing mechanism of the container.

According to the present invention, there is provided a container for consumer goods comprising an outer housing. The outer housing comprises a box and a lid hinged to the box along a hinge line and pivotable about the hinge line between an open position and a closed position. Further, the container comprises an inner package of consumer goods within the outer housing. The inner package comprises an access opening through which consumer goods can be removed when the lid of the outer housing is in the open position. The container further comprises a reclosable flap occluding the access opening of the inner package. In addition, the container comprises at least one activatable adhesive element provided on a surface of the reclosable flap, on a surface of the lid or on both. The at least one adhesive element can be selectively activated and the reclosable flap can be affixed to the lid by the at least one activated adhesive element, such that upon opening the lid the reclosable flap is lifted off the inner package to at least partly reveal the access opening.

In contrast to known containers wherein consumer goods are provided in an inner package with an access opening occluded by a reclosable flap and the inner package is received within a hinge lid box, containers according to the present invention comprise an activatable adhesive element provided on the reclosable flap, on the lid or on both. In other words, the adhesive element is supplied to the consumer in an inactive or deactivated state (that is, a non-tacky state) but can be activated so that the reclosable flap can be attached to the lid by the adhesive element. Thus, the container may be selectively configured by the consumer such that, upon opening, the lid lifts the reclosable flap off the remainder of the inner package, thereby exposing the access opening and allowing removal of the consumer goods from the inner package.

The bond between the reclosable flap and the lid is created by the consumer during use of the container and not during the manufacture of the container. This greatly simplifies the manufacturing process, because most of the issues encountered with known containers relating to the precise application of adhesive to the blank and to the automated affixing of the reclosable flap to the lid are substantially eliminated. Therefore, manufacture of the container is advantageously made comparatively quicker, easier. At the same time, more cost-effective and less complex packaging apparatus may be used.

Containers according to the present invention offer the consumer the opportunity to verify personally the quality of the sealing of the inner package upon opening the container for the first time. Further, the consumer is advantageously given the freedom to choose whether to create the bond between the lid and the reclosable flap, so that the opening and reclosing of the flap is made "automatic", or to manually open and reclose the flap every time.

In addition, the consumer is advantageously offered the opportunity to choose when to create the bond between the lid and the reclosable flap. Thus, when two (or more) bundles are provided in separate packages within a same hinge lid box, the consumer may choose to delay the first opening of a given package and the creation of a connection between the reclosable flap of that package and the lid until a certain condition is satisfied. By way of example, the consumer may choose to use up all the consumer goods contained in another package before unsealing that package and before making the opening and reclosing of that package "automatic". This advantageously helps preserve the "freshness" of the consumer goods within the package for a longer time.

Thus, in general, the present invention provides a container that is associated with an interesting, novel use routine for the consumer. This can advantageously result in an unusual, customisable and distinctive product.

In the present specification, the term "activatable" is used to describe an adhesive element that is supplied to the consumer in a non-tacky state, such that it is unable to stick to another component of the container. An activatable adhesive element requires some form of activation on the part of the consumer to be brought into a tacky state for application to another component.

Throughout the present specification, the term "selectively activated" is used to describe an adhesive element that the consumer can choose to bring from a non-tacky state into a tacky state by performing an activating (that is, state-changing) operation on the adhesive. Depending on the nature and structure of the adhesive element, different activation mechanisms are possible. An activatable adhesive element can be provided as a tacky adhesive that is protected by a covering element so that it cannot be stuck to another component of the container because direct cooperation of the adhesive element with another surface is prevented. Thus, the adhesive element can be mechanically activated by removing the protecting covering element and exposing the adhesive element to the environment. As an alternative, an activatable adhesive element can be provided as an unprotected, non-tacky substrate that can be made tacky by supply of moisture, heat, pressure, and so forth.

As used herein, the terms "front", "back", "upper", "lower", "top", "bottom" and "side", refer to the relative positions of portions of containers according to the invention and components thereof when the package is in an upright position. In the case of a hinge lid container, reference is made to an upright position of the hinge lid container wherein the lid of the outer housing is in the closed position and the hinge line at the back of the container. When describing containers according to the present invention, these terms are used irrespective of the orientation of the container being described. The back wall of the hinged lid container is the wall comprising the hinge line. The term "hinge line" refers to a line about which the lid may be pivoted in order to open the container. A hinge line may be, for example, a fold line or a score line in the panel forming the back wall of the container.

The term "inner surface" is used throughout the specification to refer to the surface of a component of the assembled container that is facing towards the interior of the container, for example towards the consumer goods, when the container is in the closed position. Likewise, the term "outer surface" is used throughout the specification to refer to the surface of a component of the container that is facing towards the exterior of the container. For example, the inner frame comprises an outer surface that is facing the outer housing of the container and an inner surface that is facing the inner package of the container. It should be noted, that the inside or outside surface is not necessarily equivalent to a certain side of a blank used in assembly of the container. Depending on how the blank is folded around the consumer goods, areas that are on the same side of the container can either face towards the inside or the towards the outside of the container.

The term "longitudinal" refers to a direction from bottom to top or vice versa. The term "transverse" refers to a direction perpendicular to the longitudinal direction.

In its most general terms, a container according to the present invention comprises an outer housing comprising a box portion and a lid (a 'hinged lid box') and an inner package of consumer goods within the hinged lid box.

The outer housing of the container may be formed from any suitable materials including, but not limited to, cardboard, paperboard, plastic, metal, or combinations thereof. Preferably, the housing is formed from one or more folded laminar cardboard blanks and preferably, the cardboard has a weight of between about 100 grams per square meter and about 350 grams per square meter. Where the container comprises an outer wrapper, preferably, the outer wrapper is a transparent polymeric film of, for example, high or low density polyethylene, polypropylene, oriented polypropylene, polyvinylidene chloride, cellulose film, or combinations thereof and the outer wrapper is applied in a conventional manner. The outer wrapper may include a tear tape. In addition, the outer wrapper may be printed with images, consumer information or other data. Preferably, the inner package is formed of metal foil or metallised paper. The inner package material may be formed as a laminate of a metallised polyethylene film, and a liner material. The liner material may be a super-calendered glassine paper. In addition, the inner package material may be provided with a print-receptive top coating.

The inner package has an access opening through which consumer goods can be removed when the lid is in the open position. A reclosable flap occludes the access opening of the inner package.

In some embodiments, the reclosable flap may substantially be defined by a portion of the inner package separable from the remainder of the inner package by separation lines. The separation lines may be provided as lines of weakness (for example, as pre-cut lines, or pre-perforated lines, and so forth). When separated from the remainder of the inner package the flap is pivotable about a hinge line between an open position and a closed position.

In other embodiments, the flap may comprise a reclosable portion covering the access opening of the inner package and extending beyond the periphery of the access opening of the inner package. Preferably, the reclosable portion is provided as a self-adhesive reclosable sticker. The self-adhesive reclosable sticker is at least partially releasably affixed to the inner package by a removable adhesive provided on a first area of the inner surface of the self-adhesive reclosable sticker. As used herein, the term "sticker" means a generally planar piece of laminar material for covering the access opening of the inner package. The sticker may, or may not, carry indicia such as trade mark material or information for the user of the container or decorative indicia.

One or more activatable adhesive elements are provided on a surface of the reclosable flap, on a surface of the lid or on both.

Preferably, one or more activatable adhesive elements are provided on the inner surface of the lid, even more preferably on the inner surface of a front wall of the lid. In addition, or as an alternative, one or more activatable adhesive elements are provided on the outer surface of the reclosable flap. As a further alternative, one or more activatable elements may be provided on the inner surface of the reclosable flap.

In some embodiments, the at least one adhesive element is protected by a layer of backing material and the layer of backing material can be removed to expose and thereby activate the adhesive element. In other embodiments, the at least one adhesive element is activatable by the application of pressure or by the supply of moisture or heat. In these embodiments, the adhesive element may be protected (that is, covered by a layer of backing material) or unprotected.

The at least one adhesive element preferably comprises a permanent adhesive. Suitable permanent adhesives are known to the skilled person and a wide variety of adhesives are commercially available from a number of suppliers. The selection of a suitable permanent adhesive may depend upon the material forming the substrate on which the adhesive element is provided.

By way of example, suitable heat-activatable adhesives include polyethylene, polypropylene, biaxially oriented polypropylene, cast polypropylene, polyvinylidene chloride, wax (mineral or natural based), polyurethane, polytetrafluoroethylene, acrylics, and combinations thereof. Suitable moisture-activatable adhesives and pressure-sensitive adhesives shall also be known to the skilled person.

In some embodiments, the container may further comprise a reinforcement frame within the inner package. In some embodiments, the reinforcement frame may be a U-shaped reinforcement frame. The term "U-shaped" is used to refer to a shape that comprises three parts, wherein the first and the third part are parallel to each other and extend into the same direction perpendicular to the second part. In practice, a U-shaped reinforcement frame is adapted to surround the bundle of consumer goods, for example of smoking articles, on three sides. Typically, a U-shaped reinforcement frame surrounds the bundle of consumer goods on one major face and on the sides, such that the ends of the consumer goods remain uncovered by the reinforcement frame. It shall be appreciated that a reinforcement frame may comprise more than three parts. For example, a reinforcement frame may further comprise a back panel or a pair of back panels, and so forth. As an alternative, in its simplest form, the reinforcement frame may consist of a single front panel.

Alternatively, the reinforcement frame may be provided on the outside of the inner package and the side walls of the reinforcement frame overlie the sides of the inner package. Advantageously, a reinforcement frame with a large surface area increases the structural strength of the container. The increased structural strength provided by the reinforcement frame allows a secure closing of the reclosable flap. This is particularly advantageous for subsequent closing operations when the container is no longer full.

In some embodiments, the inner package is received in a first portion of the volume internally defined by the outer housing and the container comprises a further inner package of consumer goods within a second portion of the internal volume of the outer housing. The further inner package comprises an access opening through which consumer goods can be removed when the lid of the outer housing is in the open position. A reclosable flap occludes the access opening of the further inner package.

Preferably, the reclosable flap of the further inner package in the second compartment is permanently affixed to the lid of the outer housing.

Preferably, the reclosable flap of the further inner package comprises a self-adhesive reclosable sticker covering the access opening of the further inner package and extending beyond the periphery of the access opening of the further inner package. Further, the self-adhesive reclosable sticker is at least partially releasably affixed to the further inner package by a removable adhesive provided on a first area of the inner surface of the self-adhesive reclosable sticker.

Thus, the consumer may selectively activate one adhesive element when opening the corresponding inner package for the first time, thus making opening of said inner package automatic with every opening of the lid. At a subsequent time, the consumer may activate the further adhesive element when accessing the content of the further inner package for the first time.

In some embodiments, the first and the second inner packages are immediately adjacent. In other embodiments, the container may comprise a partition element at least partly separating the first and the second portions of the volume internally defined by the outer housing, so that the first and the second inner packages are also separated and spaced apart. By way of example, the container may comprise a partition wall extending across the inner volume of the outer housing substantially parallel to the side walls of the box portion of the outer housing. In more detail, the partition wall may be provided in the box portion. As an alternative, the partition wall may be provided in the lid portion, such that a single, pivotable lid portion internally defines two distinct volume portions.

In some embodiments, the container may be provided with two distinct, independently pivotable, hemi-lids, each of which closes a respective hemi-container to enclose a respective one of the first and second volume portions. Thus, the adjacent side walls of the lids define a partition element separating the two volumes and the two inner packages.

The container is preferably a rectangular parallelepiped comprising two wider walls spaced apart by two narrower walls. Hinge lid containers according to the invention may be in the shape of a rectangular parallelepiped, with right-angled longitudinal and right-angled transverse edges. Alternatively, the hinge lid container may comprise one or more rounded longitudinal edges, rounded transverse edges, bevelled longitudinal edges or bevelled transverse edges, or combinations thereof. For example, the hinge lid container according to the invention may comprise, without limitation:

- One or two longitudinal rounded or bevelled edges on the front wall, and/or one or two longitudinal rounded or bevelled edges on the back wall.
- One or two transverse rounded or bevelled edges on the front wall, and/or one or two transverse rounded or bevelled edges on the back wall.
- One longitudinal rounded edge and one longitudinal bevelled edge on the front wall, and/or one transverse rounded edge and one transverse bevelled edge on the back wall.
- One or two transverse rounded or bevelled edges on the front wall and one or two longitudinal rounded or bevelled edges on the front wall.
- Two longitudinal rounded or bevelled edges on a first side wall or two transverse rounded or bevelled edges on the second side wall.

Where the container comprises one or more bevelled edge, preferably the bevelled edge has a width of between about 1 millimeters and about 10 millimeters, preferably between about 2 millimeters and about 6 millimeters. Alternatively, the hinge lid container may comprise a double bevel formed by parallel creasing or scoring lines that are spaced such that two distinct bevels are formed on the edge of the container.

Alternatively, the hinge lid container may have a non-rectangular transversal cross section, for example polygonal such as triangular or hexagonal, semi-oval or semi-circular.

Containers according to the invention find particular application as packs for elongate smoking articles such as, for example, cigarettes, cigars or cigarillos. It will be appreciated that through appropriate choices of the dimensions thereof, containers according to the invention may be designed for different numbers of conventional size, king size, super-king size, slim or super-slim cigarettes. Alternatively, other consumer goods may be housed inside the container.

Through an appropriate choice of the dimensions, containers according to the invention may be designed to hold different total numbers of smoking articles, or different arrangements of smoking articles. For example, through an appropriate choice of the dimensions, containers according to the invention may be designed to hold a total of between ten and thirty smoking articles.

The smoking articles may be arranged in different collations, depending on the total number of smoking articles. For example, the smoking articles may be arranged in a single row of six, seven, eight, nine or ten. Alternatively, the smoking articles may be arranged in two or more rows. The two or more rows may contain the same number of smoking articles. For example, the smoking articles may be arranged in: two rows of five, six, seven, eight, nine or ten; three rows of five or seven; or four rows of four, five or six. Alternatively, the two or more rows may include at least two rows containing different number of smoking articles to each other. For example, the smoking articles may be arranged in: a row of five and a row of six (5-6); a row of six and a row of seven (6-7); a row of seven and a row of eight (7-8); a middle row of five and two outer rows of six (6-5-6); a middle row of five and two outer rows of seven (7-5-7); a middle row of six and two outer rows of five (5-6-5); a middle row of six and two outer rows of seven (7-6-7); a middle row of seven and two outer rows of six (6-7-6); a middle row of nine and two outer rows of eight (8-9-8); or a middle row of six with one outer row of five and one outer row of seven (5-6-7).

In those embodiments where a first inner package and a second inner package are received in respective first and second portions of the volume internally defined by the outer housing, each package may receive a respective number of smoking article in different collations. By way of example, in each inner package, the smoking articles may be arranged in a single row of three, four, five, six, seven, eight, nine or ten. Alternatively, in each inner package, the smoking articles may be arranged in two or more rows. The two or more rows may contain the same number of smoking articles. For example, the smoking article may be arranged in: two rows of three, four, five, six, seven, eight, nine, or ten; three rows of three, four, five, or six; four rows of three, four, five or six. Alternatively, the two or more rows may include at least two rows containing different number of smoking articles to each other.

Containers according to the present invention may hold smoking articles of the same type or brand, or of different types or brands. In addition, both filter-less smoking articles and smoking articles with various filter tips may be contained, as well as smoking articles of differing length (for example, between about 40 millimeters and about 180 millimeters), diameter (for example, between about 4 millimeters and about 9 millimeters). In addition, the smoking articles may differ in strength of taste, resistance to draw and total particulate matter delivery. Preferably, the dimensions of the container are adapted to the length of the smoking articles, and the collation of the smoking articles. Typically, the outer dimensions of the container are between about 0.5 millimeters to about 5 millimeters larger than the dimensions of the bundle or bundles of smoking articles housed inside the container.

The length, width and depth of containers according to the invention may be such that the resultant overall dimensions of the container are similar to the dimensions of a typical disposable pack of twenty cigarettes.

Preferably, containers according to the invention have a height of between about 60 millimeters and about 150 millimeters, more preferably a height of between about 70 millimeters and about 125 millimeters, wherein the height is measured from the bottom wall to the top wall of the container.

Preferably, containers according to the invention have a width of between about 12 millimeters and about 150 millimeters, more preferably a width of between about 70 millimeters and about 125 millimeters, wherein the width is measured from one side wall to the other side wall of the container.

Preferably, containers according to the invention have a depth of between about 6 millimeters and about 150 millimeters, more preferably a depth of between about 12 millimeters and about 25 millimeters wherein the depth is measured from the front wall to the back wall of the container.

Preferably, the ratio of the height of the container to the depth of the container is in between about 0.3 to 1 and about 10 to 1, more preferably between about 2 to 1 and about 8 to 1, most preferably between about 3 to 1 and 5 to 1.

Preferably, the ratio of the width of the container to the depth of the container is in between about 0.3 to 1 and about 10 to 1, more preferably between about 2 to 1 and about 8 to 1, most preferably between about 2 to 1 and 3 to 1.

Preferably, the ratio of the height of the lid back wall to the height of the box back wall of the outer sleeve is between about 0 to 1 (lid located at the top edge of the container) to about 1 to 1, more preferably, between about 1 to 5 and about 1 to 10, most preferably, between about 1 to 6 to about 1 to 8.

Preferably, the ratio of the height of the lid front wall of the outer sleeve to the height of the box front wall of the outer sleeve is between about 1 to 0 (lid covering the entire front wall) to about 1 to 10, more preferably, between about 1 to 1 and about 1 to 5, most preferably, between about 1 to 2 and about 1 to 3.

Where the container comprises smoking articles, the container may further comprise waste-compartments (for example for ash or butts) or other consumer goods, for example matches, lighters, extinguishing means, breath-fresheners or electronics. The other consumer goods may be attached to the outside of the container, contained within the container along with the smoking articles, in a separate compartment of the container or combinations thereof.

The exterior surfaces of containers according to the invention may be printed, embossed, debossed or otherwise embellished with manufacturer or brand logos, trade marks, slogans and other consumer information and indicia.

Once filled, containers according to the invention may be shrink wrapped or otherwise over wrapped with a transparent polymeric film of, for example, high or low density polyethylene, polypropylene, oriented polypropylene, polyvinylidene chloride, cellulose film, or combinations thereof in a conventional manner. Where containers according to the invention are over wrapped, the over wrapper may include one or more a tear tapes. In addition, the over wrapper may be printed with images, consumer information or other data.

Containers according to the invention may be filled and assembled using conventional apparatus and methods, modified to include the step of providing a reclosable flap occluding the access opening of the inner package and the at least one activatable adhesive element.

In use, when opening the container for the first time, the user

The invention will be further described, by way of example only, with reference to the accompanying drawings in which.

Figure 1:
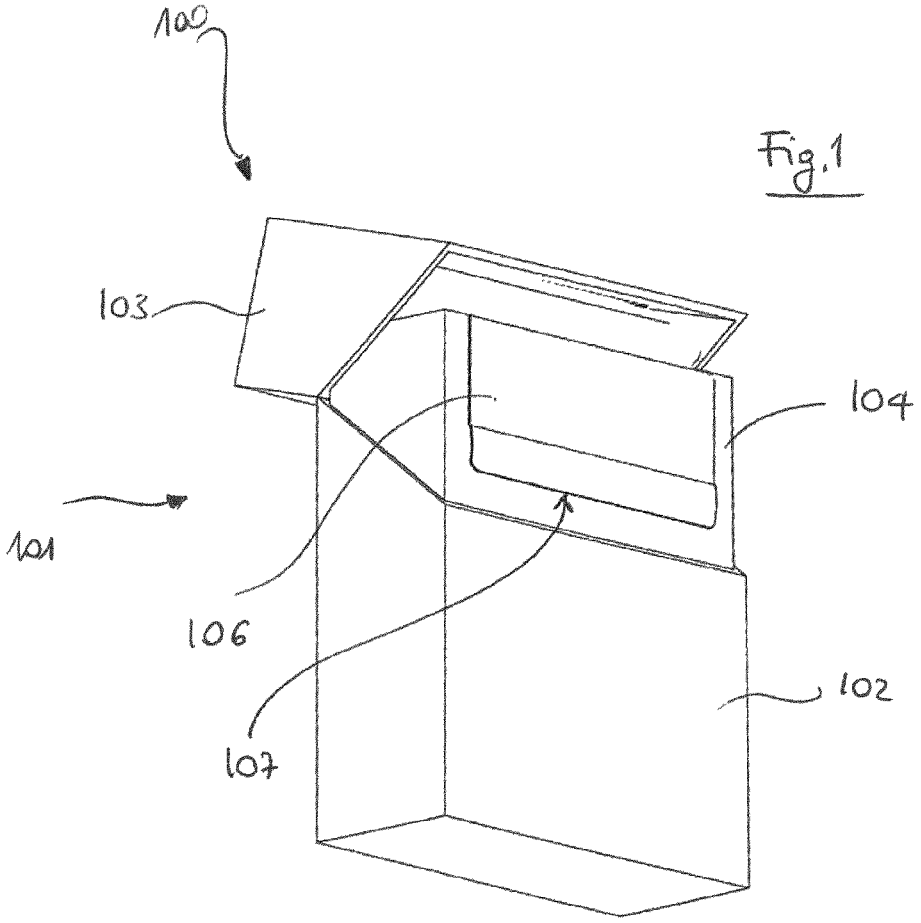
FIG. 1 shows a schematic perspective view of a first embodiment of a container in accordance with the present invention, seen upon opening the container for the first time, with the activatable adhesive element in a non-active state.
Figure 2:
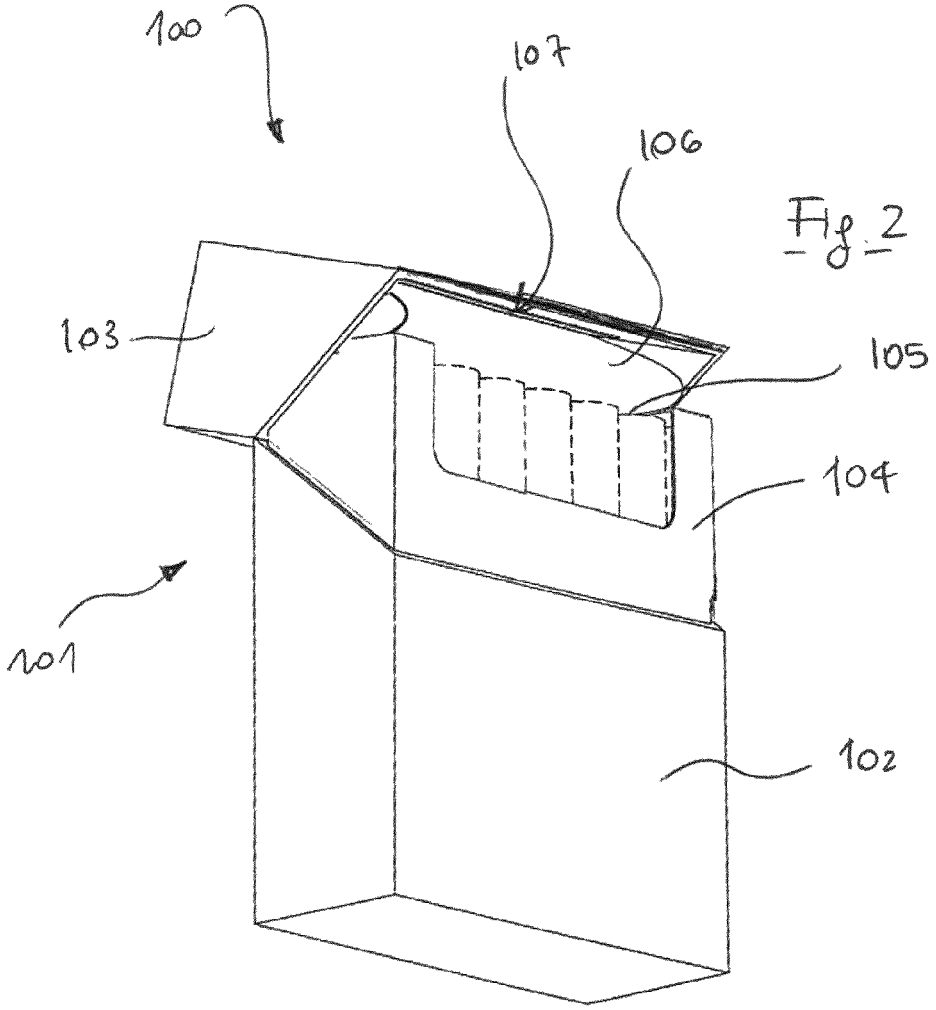
FIG. 2 shows a schematic perspective view of the container of FIG. 1, seen with the activatable adhesive element in an active state and used to attach the reclosable flap to the lid.

The container 100 of FIGS. 1 and 2 comprises a conventional hinge-lid outer housing 101 comprising a box 102 and a hinge lid 103 depending from the box 102 along a hinge line extending across a back wall of the housing 101. The overall size and construction of the box 102 and lid 103 of container 100 are substantially the same as that of a standard hinge lid cigarette pack.

As illustrated in FIG. 1, which shows the container 100 being opened for the first time, the container 100 comprises an inner package 104 of consumer goods within the outer housing 101. The inner package 104 comprises an access opening 105 (not shown in FIG. 1, but visible in FIG. 2) through which consumer goods can be removed when the lid 103 of the outer housing 101 is in the open position. Further, the inner package 104 comprises a reclosable flap 106 occluding the access opening 105. In more detail, the flap 106 comprises a reclosable portion that is provided as a reclosable sticker that covers the access opening 105 of the inner package 104 and extends beyond the periphery thereof. The reclosable sticker is at least partly releasably affixed to the inner package 104 by a removable adhesive provided on a first area of the inner surface of the self-adhesive reclosable sticker.

An activatable adhesive element 107 is provided on the outer surface of the reclosable flap 106. In more detail, the adhesive element 107 is provided as a protected adhesive element comprising a layer of adhesive covered by a layer of backing material. The layer of backing material can be removed to expose and thereby activate the adhesive element 107.

As illustrated in FIG. 2, the reclosable flap 106 may be affixed to the lid 103 by the activated adhesive element. Thus, upon opening the lid 103 the reclosable flap 106 is lifted off the inner package 104 to at least partly reveal the access opening 105.

Figure 3:
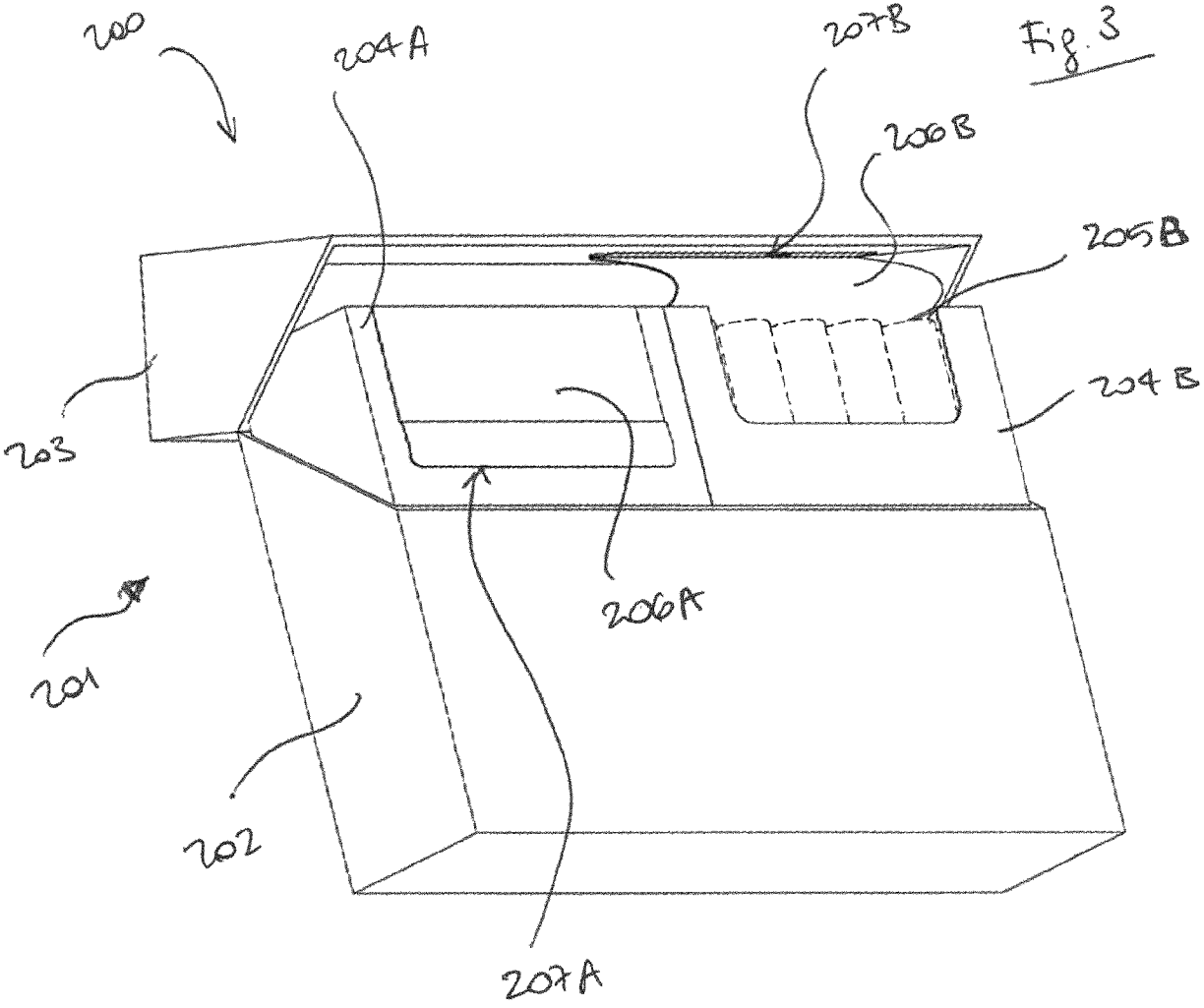
FIG. 3 shows a schematic perspective view of a second embodiment of a container in accordance with the present invention comprising two inner packages in a first use configuration.
Figure 4:
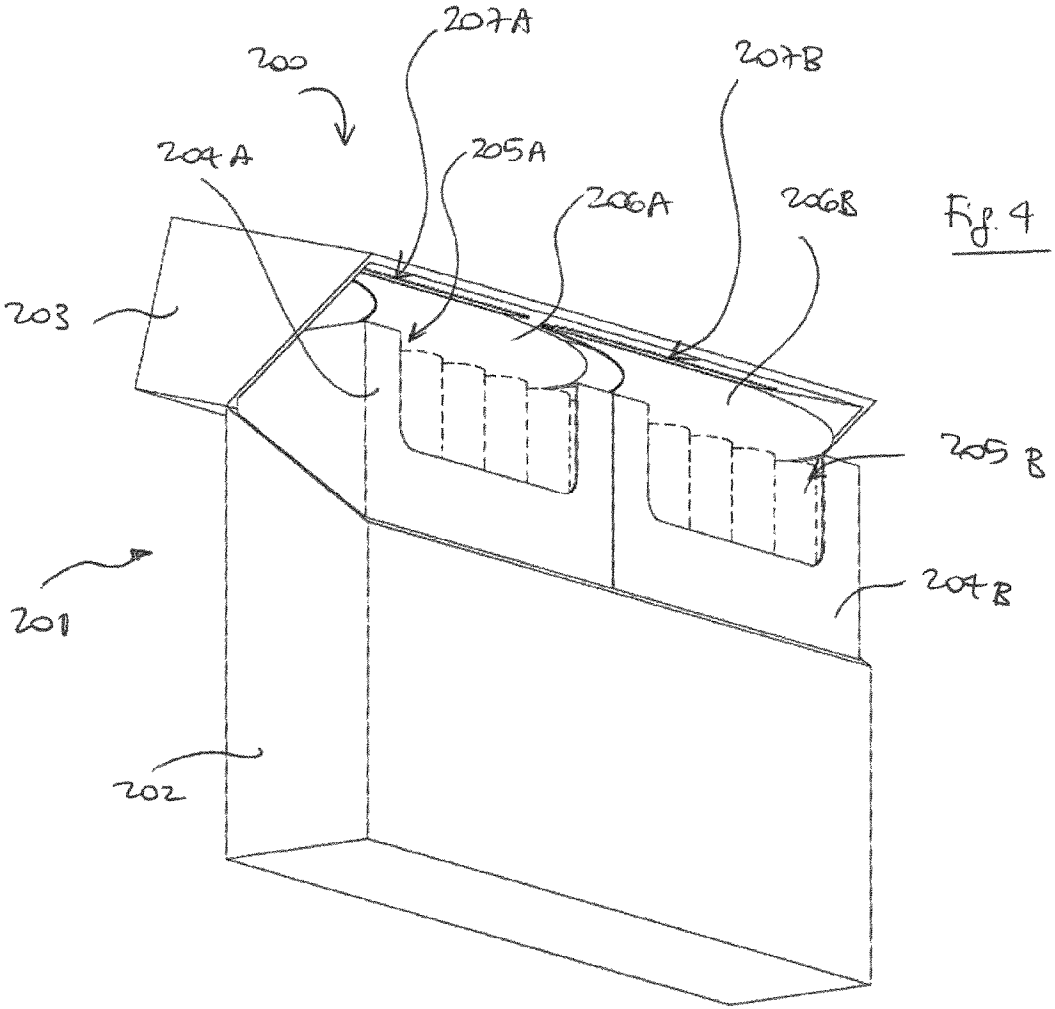
FIG. 4 shows a schematic perspective view of the container of FIG. 3 in a second use configuration.

The container 200 of FIGS. 3 and 4 comprises a hinge-lid outer housing 201 comprising a box 202 and a hinge lid 203 depending from the box 202 along a hinge line extending across a back wall of the housing 201. The overall size of the box 202 and lid 203 of container 200 is substantially twice as that of a standard hinge lid cigarette pack. In more detail, the container 200 has substantially the same height and depth of the container 100 of FIGS. 1 and 2, but it is twice as wide, so that it can contain twice as many consumer articles, for example like cigarettes.

A first inner package 204A of consumer is received in a first portion of the volume internally defined by the outer housing 201. A second inner package 204B is received in a second portion of the volume internally defined by the outer housing 201. In practice, the first and the second inner packages are adjacent within the outer housing 201. Both inner packages 204A and 204B have respective access openings 205A, 205B through which consumer articles can be removed when the lid 203 is in an open position. Respective reclosable flaps 206A, 206B occlude the access openings 205A, 205B.

Both reclosable flaps 206A, 206B are provided as reclosable stickers that cover the access openings 205A, 205B of the inner packages 204A, 204B and extend beyond the respective peripheries of the access openings. The reclosable stickers are at least partly releasably affixed to the inner packages 204A, 204B by a removable adhesive provided on the inner surface of the self-adhesive reclosable stickers.

Respective activatable adhesive elements 207A, 207B are provided on the outer surface of the reclosable flaps 206A, 206B. In more detail, the adhesive elements are provided as protected adhesive elements, each of which comprises a layer of adhesive covered by a layer of backing material, wherein the layer of backing material can be removed to expose and thereby activate the underlying adhesive element. Thus, the consumer may choose to attach one (as illustrated in FIG. 3) or both (as illustrated in FIG. 4) of the reclosable flaps 206A, 206B to the lid 203.

The invention claimed is:

1. A container for consumer goods comprising:

an outer housing comprising:

a box; and a lid hinged to the box along a hinge line and pivotable about the hinge line between an open position and a closed position;

an inner package of consumer goods within the outer housing comprising an access opening through which consumer goods can be removed when the lid of the outer housing is in the open position; and a reclosable flap occluding the access opening of the inner package;

wherein the container comprises at least one activatable adhesive element provided on a surface of the reclosable flap of the inner package, on a surface of the lid or on both; and wherein the at least one activatable adhesive element is supplied to the consumer in an inactive or deactivated state and can be selectively activated and the reclosable flap of the inner package can be affixed to the lid by the at least one adhesive element once it has been selectively activated, such that upon opening the lid the reclosable flap of the inner package is lifted off the inner package to at least partly reveal the access opening;

wherein the inner package is received in a first portion of a volume internally defined by the outer housing; and wherein the container comprises a further inner package of consumer goods within a second portion of the volume internally defined by the outer housing adjacent the first portion of the volume, the further inner package comprising an access opening through which consumer goods can be removed when the lid of the outer housing is in the open position, and a reclosable flap occluding the access opening of the further inner package, the reclosable flap of the further inner package in the second portion of the volume being permanently affixed to the lid of the outer housing.

2. A container according to claim 1, wherein the reclosable flap of the inner package is defined by separation lines in the inner package, such that the reclosable flap of the inner package is at least partly separable from the remainder of the package, wherein upon separation from the remainder of the package the reclosable flap of the inner package is pivotable about a hinge line between an open position and a closed position.

3. A container according to claim 1, wherein the reclosable flap of the inner package comprises a reclosable portion covering the access opening of the inner package and extending beyond the periphery of the access opening of the inner package.

4. A container according to claim 3, wherein the reclosable portion is provided as a self-adhesive reclosable sticker; the self-adhesive reclosable sticker being at least partially releasably affixed to the inner package by a removable adhesive provided on a first area of the inner surface of the self-adhesive reclosable sticker.

5. A container according to claim 1, wherein the at least one activatable adhesive element is provided on the inner surface of the lid.

6. A container according to claim 1, wherein the at least one activatable adhesive element is provided on the outer surface of the reclosable flap of the inner package.

7. A container according to claim 3, wherein the at least one activatable adhesive element is provided on a portion of the inner surface of the reclosable flap of the inner package not affixed to the inner package.

8. A container according to claim 1, wherein the at least one activatable adhesive element is protected by a layer of backing material and the layer of backing material can be removed to expose and thereby activate the at least one activatable adhesive element.

9. A container according to claim 1, wherein the at least one activatable adhesive element is at least one of a pressure-sensitive adhesive, a moisture-sensitive adhesive and a heat-activatable adhesive.

10. A container according to claim 1, wherein the at least one activatable adhesive element is a permanent adhesive element.

11. A container according to claim 1, wherein the reclosable flap of the further inner package comprises a self-adhesive reclosable sticker covering the access opening of the further inner package and extending beyond the periphery of the access opening of the further inner package; and wherein the self-adhesive reclosable sticker is at least partially releasably affixed to the further inner package by a removable adhesive provided on a first area of the inner surface of the self-adhesive reclosable sticker.

12. A container according to claim 1, wherein the container comprises a partition element at least partly separating the first and second portions of the volume internally defined by the outer housing.

13. A container according to claim 1, wherein the container comprises two distinct, independently pivotable, lids, each of which closes a respective one of the first and second volume portions, so that adjacent side walls of the two lids define a partition element separating the two volumes and the first and the further inner packages received in the two volumes.

14. A container according to claim 1 wherein the consumer goods are smoking articles.

* * * * *